United States Patent [19]

Matts

[11] Patent Number: 4,756,779

[45] Date of Patent: Jul. 12, 1988

[54] PROCESS FOR THE PRODUCTION OF PARTICULATE, WATER RESISTANT EXPLOSIVES BASED ON AMMONIUM NITRATE

[75] Inventor: Terrence C. Matts, North Vancouver, Canada

[73] Assignee: C-I-L Inc. Inc., North York, Canada

[21] Appl. No.: 98,569

[22] Filed: Sep. 21, 1987

[30] Foreign Application Priority Data

Oct. 8, 1986 [CA] Canada ..... 520070

[51] Int. Cl.[4] ..... D03D 23/00

[52] U.S. Cl. ..... 149/109.6; 149/6; 149/7; 149/8; 149/2; 102/313

[58] Field of Search ..... 149/2, 8, 6, 7, 109.6; 102/313

[56] References Cited

U.S. PATENT DOCUMENTS

| | | | |
|---|---|---|---|
| 2,654,666 | 10/1953 | Taylor | 52/11 |
| 3,453,155 | 7/1969 | Sheeran et al. | 149/5 |
| 3,764,419 | 10/1973 | Sheeran | 149/7 |
| 3,834,955 | 9/1974 | Fox et al. | 149/7 |
| 4,367,103 | 1/1983 | Enever | 149/7 |
| 4,384,903 | 5/1983 | Enever | 149/7 |
| 4,614,146 | 9/1986 | Ross et al. | 102/313 |
| 4,637,849 | 1/1987 | Harris, Jr. | 149/43 |
| 4,693,763 | 9/1987 | Ross et al. | 149/8 |

FOREIGN PATENT DOCUMENTS

| | | |
|---|---|---|
| 605640 | 9/1960 | Canada . |
| 1156393 | 5/1958 | France . |
| 59 | 5/1867 | Sweden . |

*Primary Examiner*—Stephen J. Lechert, Jr.
*Attorney, Agent, or Firm*—Donald G. Ballantyne

[57] ABSTRACT

An improved process for the manufacture of water resistant dry blasting agents. Powdered, solid, water blocking agent and solid fuel, if required, is added as a suspension in a liquid non-hydrating fuel phase to porous ammonium nitrate prills. The process thus avoids unevenness of coating with water blocking agent of prior art processes and is particularly suited to on-site truck mounted manufacturing of water resistant blasting agents.

8 Claims, 1 Drawing Sheet

Figure 1:
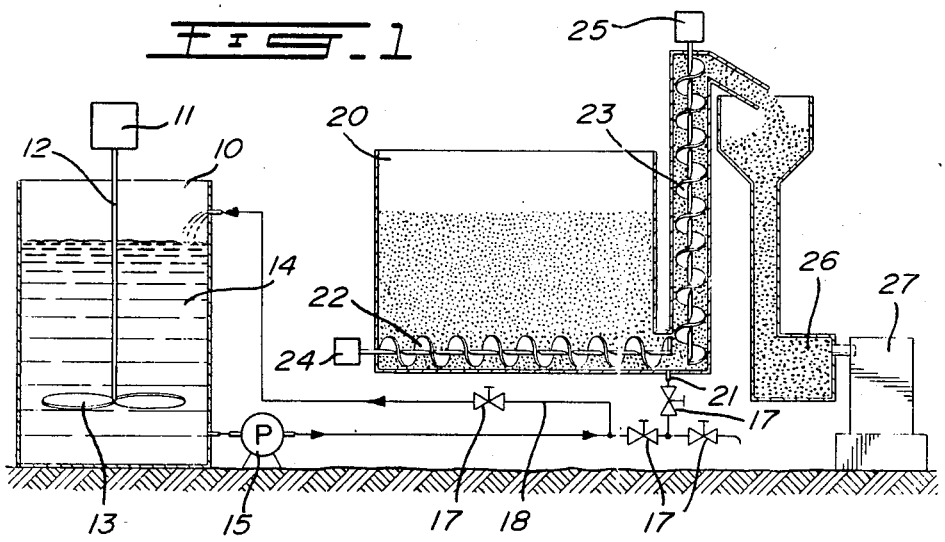

PROCESS FOR THE PRODUCTION OF PARTICULATE, WATER RESISTANT EXPLOSIVES BASED ON AMMONIUM NITRATE

This invention relates to the production of water resistant ammonium nitrate prill based explosives. In particular, the invention relates to an improved production method for water resistant ANFO type blasting agents.

Ammonium nitrate (AN) is a well-known, inexpensive and energy conferring constituent of commercially valuable explosives. The addition of small amounts of fuel, such as, a hydrocarbon oil or fuel oil (FO), to AN in its regularly manufactured, prilled particulate form gives a free-flowing particulate explosive commonly known as ANFO. This type of explosive was first claimed specifically in French patent No. 1,156,393 to Chatel and, more generally, in Swedish unnumbered patent to Norrbin et al dated May 31, 1867.

Since the ingredients for ANFO are usually inexpensive grades of AN, in low density prill form, and diesel oil, the explosive is very economical. However, ANFO suffers one major disadvantage; the presence of even small amounts of water in the blast hole can seriously affect performance. For example, in the presence of more than approximately 10% by weight of water, rapid and complete desensitization occurs and the explosive fails to detonate. The use of film bags or hole liners has been tried with sore success to overcome this difficulty. However, liners are generally inconvenient and difficult to use and bags often create difficulties by becoming hung up or split open or even floating up on the water in the hole.

As a result of these difficulties in amp or wet conditions, ANFO is generally substituted for with much more highly water resistant explosives, such as gelled slurry explosives or inverted emulsion explosives. Both these newer types of explosives are considerably more expensive and less energetic on a weight basis than ANFO due, respectively, to the presence of highly refined extra components and substantial amounts of ingredient water. More recently, water resistant combinations of AN or ANFO with these explosives have become not uncommonly used. However, all these alternatives to ANFO remain expensive and difficult to manufacture, particularly with truck mounted preparation equipment operating at blast sites.

The use of guar and other water absorbing agents in explosives as a damp condition performance improver is well known. Taylor in U.S. Pat. No. 2,654,666 describes guar flour as a dynamite ingredient. Falconer in Canadian patent No. 605,640 describes the use of other polysaccharides in ANFO. Sheeran in U.S. Pat. No. 3,764,419 discloses the use of cross-linkable thickening polyacrylamides in glycol/water containing blasting agents. Sheeran further mentions in U.S. Pat. No. 3,453,155 the use of guar gum flours to confer "desirable", but not more closely defined, properties to ANFO based explosives.

Despite this prior art, only recently has it become common practice to use guar at 1% or greater levels as a dry ingredient in ANFO. It is generally postulated the resulting observed water resistance arises for two reasons; on contact with liquid extraneous water in the borehole, the guar rapidly hydrates to form a gel-like barrier which, in turn, hinders further water penetration and, the gel so formed slows displacment of oil from the prills by the water.

Preparation of ANFO can be performed on a batch basis but, in commercial practice, it is almost exclusively made using continuous equipment for well known reasons concerning safety, thoughput, quality and consistency of product. In regular continuous plant for preparing water resistant ANFO (ANFO/WR), the water blocking powder must be added in a well regulated continuous stream to an auger fed stream of pre-oiled prills. Guar flour and other powdered water blocking agents are not easy to add in this way. Difficulties are found to oocur in this as in all engineering fields with small flow, auger feeds. There is a strong tendency of fine powders to bridge in the storage hoppers thereby reducing or interrupting the flow intermittently and unpredictably. Vibration induced compaction of the powder generally worsens this problem. Frequent checks of flow are needed and this is difficult or impractical particularly in field conditions where AN and FO feeds must be halted while calibrating the flow. It has also been found that the water blocking powder does not adhere evenly or well to the prills when added sequentially after the oil and an inferior product is produced.

The present invention provides a modified mixing method which avoids these production difficulties and provides effective water resistance from a minimum of guar or other thickening or water gelling agent.

The method of the invention comprises agitating the ammonium nitrate prills while adding thereto a non-hydrating liquid carbonaceous fuel, said liquid fuel having suspended therein from 10 to 200% by weight of the liquid fuel of at least one powdered solid water blocking agent and, optionally, up to 150% by weight of the liquid fuel of other particulate solid fuels, the content of said water blocking agent and said particulate fuel comprising in combination up to 200% by weight of said liquid fuel.

Figure 2:
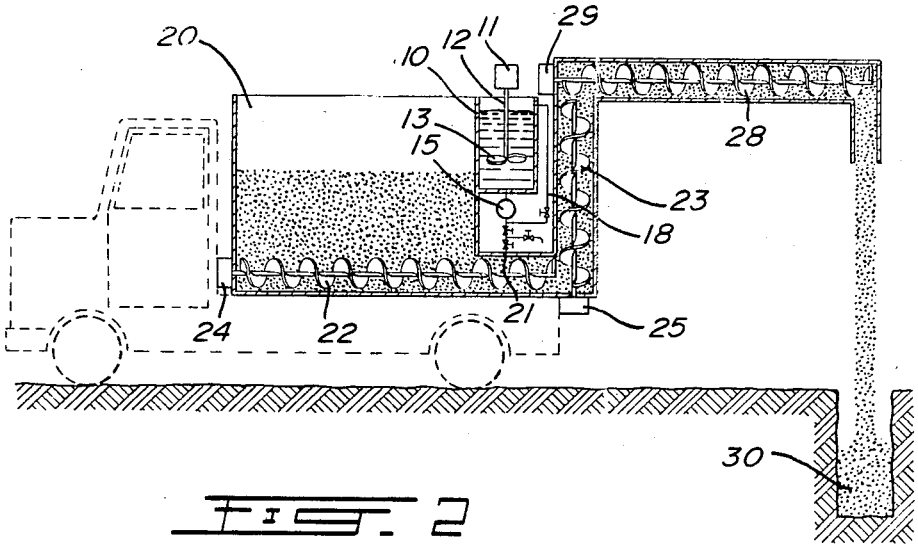

In order that the invention may be better understood, regular practice of the art and the practice of the invention will be described by way of example only with reference to the drawings wherein:

FIG. 1 is a schematic diagram of a fixed mechanical mixing apparatus or plant designed for production of ANFO type explosives; and FIG. 2 is a cross-sectional view of a truck mounted plant of the same type.

In FIG. 1, there is shown liquid fuel tank 10 fitted with agitator 13, drive shaft 12 and drive motor 11. Fuel tank 10 is also fitted with an outlet connected to pump 15 and further connected by lines and valves 17 to injection nozzle 21 and recirculation loop 18. AN hopper 20 is also shown fitted with augers 22 and 23 and auger drive motors 24 and 25 and also shown is an air bagging unit 26 and bag 27.

In FIG. 2, there is shown a similar truck mounted arrangement using an extra auger 28 and drive 29 for delivery of product through an adjustable boom to a blast hole 30.

In the continuous manufacture of regular, prior art ANFO, as is preferred in truck-mounted applications, liquid fuel oil is continuously sprayed onto the moving stream of AN prills as they are conveyed in the closed auger conduit. The agitation provided by the auger is generally sufficient to give even distribution of the oil. Referring to FIG. 1, horizontal auger 22 causes a continuous stream of prills to be moved forward along the bottom of tank 20 and over sprayhead 21 where oil from a pump 15 and tank 10 is continuously injected. Subsequent agitation in transport by vertical auger 23 provides adequate mixing. Manufacturing units operating on this principle are commonly encountered in the industry. Equipment needed to manufacture regular ANFO differs from the apparatus of the preferred embodiment only in the respect that fuel tank 10 is not fitted with an agitator, shaft and a drive motor and recirculation loop 18 may also be not fitted.

In actual operation of a preferred embodiment, the required amount of diesel oil, or other liquid non-hydrating fuel for anticipated production requirements, is added to the tank 10 which is fitted with an agitator 13. The agitator motor 11 is started, as is the pump 15 driving the recirculation system. The necessary quantities of water blocking agent are then added to tank 10, as are any additional, optional solid fuels such as, for example, powdered light metals or sulphur. If the solids to be added are lumpy, they should be screened to a small enough size to prevent blockage of the pump and recirculating system. Handling precautions should be used when adding the water blocking agent and optional solid fuels because of their usually dusty nature.

When the oil/blocking agent mixture is homogeneous, the addition rate of the suspension can be determined by opening valves to a sampling port and collecting over a measured time. This addition rate can be adjusted using a metering valve. During a production run, the delivery of prills at a fixed, known rate through the continuous mixer is started at the same time as the valve to the nozzle 21 is opened. The recirculating pumping system must be reasonably carefullly designed to avoid settling out of the solid materials at low points, and to avoid blockages at restrictions. A thickener for the liquid non-hydrating fuel such as, a polymeric thickener can be useful to reduce this effect, though the viscosity of the liquid should not be raised too high or pumping problems will result and the liquid fuel may not efficiently penetrate the pores of the AN prills. This lack of penetration will cause low velocity detonations and inefficient energy delivery to the rock. The recirculating system should be provided with clean-out provisions. It is not necessary to provide any particular jet or restriction at the inlet port where the suspension mixes with the AN prills. After production has ceased, it is helpful to flush the recirculating system with fresh liquid fuel.

It will be clear to those skilled in the explosives manufacturing art that either one of the agitator or the recirculation loop may singly be sufficient to effectively suspend the particulate materials. However, the combination is generally more effective. This effectiveness may also be improved by fitting baffles within the liquid fuel oil storage tank.

In order to demonstrate of the improved product and manufacturing method of the invention, the following experiments were carried out:

EXPERIMENT I (a) 1 part of guar gum (by weight) was stirred into 1 part of diesel oil, to form a smooth, fluid suspension. The mixture was added to 18 parts of AN prills and mixed rapidly by hand. The AN prills rapidly soaked up the oil leaving an even coating of guar on their surfaces.

(b) 3 parts of guar gum (by weight) and 3 parts of fine flowers of sulphur were stirred into 4 parts of diesel oil, to form a smooth, thick suspension. The mixture was added to 90 parts of AN prills and mixed rapidly by hand. The AN prills rapidly soaked up the oil to leave an even coating of guar and sulphur.

Both mixtures (a) and (b) above were noticeably less dusty than their analogues prepared by adding the oil first and guar plus sulphur, if used, in dry form later in the mix cycle.

EXPERIMENT II

A recirculating system incorporating a 1-inch Jabsco* pump driven by a ¾ HP electric motor was fitted to a fixed, modified, Amerind* ANFO production unit, as shown in FIG. 1. A blend of 9 parts of diesel oil (by weight), 6 parts of JaGUAR 170 (Trade Mark, a guar gum), 5 parts of fine flowers of sulphur, and a trace of oil soluble dye was prepared. The suspension pumped easily and no blockages occurred providing lumps of sulphur were broken up. The system was calibrated to add 1 part of the blend (by weight) to 9 parts of AN prills. In the trial run which followed, 29 bags each containing 25 kg of water-resistant ANFO were mixed and bagged off with absolutely no problems at the normal production rate as for regular ANFO of approximately 200 kg per minute. No dust was produced by the air bagging unit, while examination of the product showed it to be dry with an even coloration on all the AN prills. This indicated that homogenous absorption of oil took place, giving a tight, even surface coating of guar and sulphur on the prills.

*Reg. TM

The material produced in the above trial (c) was compared to material of the same formula mixed using a different procedure (d) in which guar and sulphur were added dry to a batch mixer containing pre-blended diesel oil and AN prills.

1. Material (d) was more dusty than (c), while the coating in (d) was looser and less evenly distributed on the prills.

2. In beaker tests using the same weights of water-resistant ANFO and the same volumes of added water, material (c) gave a more rapid and firmer gel indicating better water resistance.

3. Shooting tests were carried out in thick-wall steel pipes of 60 mm inside diameter. When initiated with a small cast pentolite primer, the following average velocities of detonation were obtained: 3.6 km/s for material (c) and 3.0 km/s for material (d).

Therefore, the blasting results obtainable with material (c) should be superior to those with material (d).

Additionally, field trials were carried out where material (c) was loaded into horizontal 65 mm diameter boreholes using compressed air. Little dust was evident during loading while the blasting results were very satisfactory even under quite wet conditions.

The optional particulate fuels may be selected from aluminium, sulphur, powdered coal, dinitrotoluene or other materials which make the explosive more energetic. It will also be clear that the non-hydrating carbonaceous fuel component may be any liquid material hydrophobic enough in character not to cause rapid swelling and caking by hydration of the water blocking agent. Regular diesel oil is the liquid fuel of economic choice but many common hydrocarbons or halogenated hydrocarbons such as, for example, lubricating oil, pentane, hexane, heptane, gasoline, kerosene, liquid paraffin, light fuel oil, benzene, toluene, xylene and trichlorethylene could be used. Higher energy content, non-self-explosive liquids, such as, nitropropane, nitroethane and others well known in the art may be used. Nitropropane and nitroethane carry part of their oxygen requirements for combustion or explosion within their molecular structure as the nitro group. Such energetic materials may be referred to as fuels containing a molecular oxidizing portion.

The water blocking agent is to be selected from those materials which swell and hydrate rapidly on contact with cold water and nitrate solutions. These materials are well known in the art and may comprise one or more singly or in combinations of the following: guar gums, chemically modified guar gums, galactomannan gums, pre-gelatinized starch, hydroxy-ethyl cellulose, polyacrylamide, and sodium montmorillonite. Certain water blocking agents (notably guar gum) are capable of being cross-linked to form a stable gel after hydration. Appropriate cross-linking agents, which act slowly so as not to interfer with hydration of the water blocking agent, may be incorporated in with the guar. For example, potassium pyroantimonate is well known to show such activity. Addition of oil soluble dyes can aid visual checking of the distribution of the coating on the prills.

It will be clear to those skilled in the art that ANFO/WR may also be advantageously manufactured on a batch basis using a suspension herein disclosed of water blocking agent in the liquid fuel.

The ANFO/WR of the invention may be used advantageously in combination with regular slurry or emulsion blasting agents. The use of one of the higher density explosives as toe load and of ANFO/WR in the column, where drier conditions exist, is one economical variant. Alternatively, mixtures of ANFO/WR may be made with slurry or emulsion explosives to provide enhanced water resistance over that expected with regular ANFO combinations.

I claim:

1. An improved process for the manufacture of water resistant particulate ammonium nitrate based explosives wherein the improvement comprises agitating porous ammonium nitrate prills while adding thereto a suspension of solid water blocking agent in a non-hydrating liquid carbonaceous fuel, said suspension containing from 10 to 200% by weight of the solid agent as a proportion by weight of the liquid fuel.

2. A process as claimed in claim 1 wherein the liquid fuel has also in suspension a solid particulate fuel in an amount up to 150% of the weight of the liquid fuel and wherein said solid fuel and said water blocking agent comprise together up to 200% by weight solids as a proportion of the liquid fuel weight.

3. A process as claimed in claim 1 or 2 which is continuous.

4. A process as claimed in claim 1 or 2 wherein the water blocking agent is selected from the group consisting of guar gums, chemically modified guar gums, galactomannan gums, pregelatinized starches, hydroxyethyl-celluloses, polyacrylamides and sodium montmorillonite and mixtures thereof.

5. A process as claimed in claim 1 or 2 wherein said non-hydrating liquid carbonaceous fuel is selected from the group consisting of diesel oil, lubricating oil pentane, hexane, heptane, gasoline, kerosene, liquid paraffin, light fuel oil, toluene, benzene, xylene and trichlorethylene and mixtures thereof.

6. A process as claimed in claim 1 or 2 wherein the non-hydrating liquid fuel comprises a molecular oxidizing portion or component.

7. A process as claimed in claim 1 or 2 wherein the water blocking agent additionally comprises a proportion of a slow cross-linking agent.

8. A process as claimed in claim 1 or 2 wherein the liquid fuel additionally contains a thickener.

* * * * *